US009410700B2

(12) United States Patent
Barendregt et al.

(10) Patent No.: US 9,410,700 B2
(45) Date of Patent: Aug. 9, 2016

(54) BURNER AND A FURNACE COMPRISING SUCH A BURNER

(75) Inventors: Simon Barendregt, Le Trait (FR); Franciscus Arnoldus Maria Jeunink, Le Trait (FR); Izaak Jacobus Risseeuw, Le Trait (FR)

(73) Assignee: Technip France, Courbevoie (FR)

( * ) Notice: Subject to any disclaimer, the term of this patent is extended or adjusted under 35 U.S.C. 154(b) by 394 days.

(21) Appl. No.: 13/980,444

(22) PCT Filed: Jan. 20, 2012

(86) PCT No.: PCT/EP2012/050870

§ 371 (c)(1),
(2), (4) Date: Sep. 6, 2013

(87) PCT Pub. No.: WO2012/098229

PCT Pub. Date: Jul. 26, 2012

(65) Prior Publication Data

US 2014/0038116 A1 Feb. 6, 2014

(30) Foreign Application Priority Data

Jan. 21, 2011 (EP) ..... 11151640

(51) Int. Cl.
*F23D 14/22* (2006.01)
*F23D 14/58* (2006.01)

(52) U.S. Cl.
CPC ..... *F23D 14/22* (2013.01); *F23D 14/58* (2013.01); *F23D 14/583* (2013.01)

(58) Field of Classification Search
CPC ..... F23D 4/22; F23D 4/58; F23D 4/583; F23D 14/22; F23D 14/583; F23D 14/58
USPC ..... 431/187
See application file for complete search history.

(56) References Cited

U.S. PATENT DOCUMENTS 6,544,029 B2 4/2003 Marin et al.
8,545,213 B2 * 10/2013 Hendershot ..... F23D 14/84 422/625

(Continued)

FOREIGN PATENT DOCUMENTS

CN 101063524 A 10/2007
FR 2 880 410 7/2006

(Continued)

OTHER PUBLICATIONS

PCT International Search Report dated Oct. 23, 2012 (Form PCT/ISA/210) (2 pages).

(Continued)

*Primary Examiner* — Alfred Basichas
(74) *Attorney, Agent, or Firm* — Locke Lord LLP; Alan B. Clement; Peter J. Fallon

(57) ABSTRACT

Burner for a furnace comprising at least one supply channel for supplying an oxidizing medium and a plurality of peripheral fuel supply channels, wherein the channels have exit openings arranged adjacent each other at a burner end surface for forming during use upon reaction of supplied fuel with supplied oxidizing medium a flame front, wherein the exit openings are asymmetrically arranged with respect to any plane arranged transverse to the end surface of the burner and extending through a burner central axis whereby the distribution of the fuel exit openings and/or the dimension of the fuel exit openings and/or the exit angle of the fuel exit openings and/or the shape of the fuel exit openings are arranged asymmetrically to said any plane, such that during use a flame front is created that is asymmetrical with respect to said any plane.

7 Claims, 4 Drawing Sheets

(56) References Cited

U.S. PATENT DOCUMENTS

| | | | | |
|---|---|---|---|---|
| 2003/0148236 | A1 | 8/2003 | Joshi et al. | |
| 2007/0099141 | A1* | 5/2007 | Joshi | B01J 8/062 431/354 |
| 2007/0254251 | A1 | 11/2007 | Cao et al. | |
| 2008/0096146 | A1* | 4/2008 | Li | F23C 6/045 431/9 |

FOREIGN PATENT DOCUMENTS

| | | |
|---|---|---|
| JP | A01300103 | 12/1989 |
| JP | H849812 | 2/1996 |
| JP | A9112814 | 5/1997 |
| JP | A10238711 | 9/1998 |
| JP | 200088212 | 3/2000 |
| JP | 2008513721 | 5/2008 |
| JP | 2008527292 | 7/2008 |
| WO | WO 2010/023256 A1 | 3/2010 |

OTHER PUBLICATIONS

Chinese First Office Action dated Dec. 18, 2014 for Patent Application No. 201280006087.2 in Chinese and its English translation.
Japanese Office Action dated Dec. 21, 2015 for Patent Application No. 2013-549829 in Japanese and its English translation.

* cited by examiner

BURNER AND A FURNACE COMPRISING SUCH A BURNER

This application is a National Stage patent application of International Patent Application Number, PCT/EP2012/050870, filed on Jan. 20, 2012, which claims priority to EP 11151640.7, filed on Jan. 21, 2011.

The invention relates to burners for furnaces.

Such burners are known and widely used for high and/or low temperature furnaces such as industrial cracking installations or heaters or steam reformers. A high temperature furnace is understood to be a furnace for industrial production use, thus not on laboratory scale, which operates at relatively high temperatures. Typically the temperature operation range is between approximately 1100° C. and approximately 1400° C. The operation temperature is rather critical to maintain. Such burners may also be used in low temperature furnaces operating at temperatures outside the range of 1100° C.-1400° C. Usually, the burners are wall mounted or floor mounted or roof mounted in the radiant section of the firebox. The burners produce a flame front that heats the furnace. In the furnace process tubes are arranged through which product to be processed, e.g. hydrocarbons to be cracked, runs with a relatively high speed. To increase the production, burners are usually positioned in a relatively compact arrangement. A drawback of the burners and/or their relatively compact arrangement is that flame-to-flame interaction or flame rollover towards the process tubes may occur that even may reach the tubes. This significantly decreases the efficiency of the process and the lifetime of the tubes. Due to flame rollover, the cokes forming inside the tubes is accelerated which reduces the time interval between decoke cycles, the efficiency of the process and the capacity of the furnace. Further, due to flame impingement on process tubes the atmosphere outside the tubes is alternating reducing/oxidizing resulting in tube material degradation. This increases the costs and reduces the furnace availability and/or capacity.

An object of the invention is to provide a burner that obviates at least one of the above mentioned drawbacks.

Thereto, the invention provides for a burner for a furnace comprising at least one supply channel for supplying an oxidizing medium and a plurality of peripheral fuel supply channels, wherein the oxidizing medium supply channel and the fuel supply channels have exit openings arranged adjacent each other at a burner end surface for forming during use upon reaction of supplied fuel with supplied oxidizing medium a flame front, wherein the exit opening of the oxidizing medium supply channel and the exit openings of the fuel supply channels are asymmetrically arranged with respect to any plane arranged transverse to the end surface of the burner and extending through a burner central axis whereby the distribution of the fuel exit openings and/or the dimension of the fuel exit openings and/or the exit angle of the fuel exit openings and/or the shape of the fuel exit openings are arranged asymmetrically to said any plane, such that during use a flame front is created that is asymmetrical with respect to said any plane. By providing the arrangement of the fuel exit openings and the oxidizing medium exit opening such that an asymmetrical flame front is obtained, interaction of the flame fronts of adjacent burners can be obviated and/or minimized, thereby reducing the risk on flame rollover. The applicant has experimentally determined that flame rollover with burners producing an asymmetrical flame front is practically absent. Thus, the lifetime, costs, efficiency and/or capacity of the tubes and/or the furnace becomes more predictable and may become more controllable.

It is noted that known burners are configured to produce flames with symmetrical flame fronts. In fact, known burners need to comply to with burner standards in which symmetrical flame shapes (such as conical, cylindrical or fish tail shapes) are guaranteed. Such burner standard is for instance defined in "Burners for Fired Heaters in General Refinery Services, API Recommended Practice 535 (Second Edition, January 2006)".

Such burners are for instance known from US 2003/148236 which describes an ultra low NOx burner, wherein around a large scale vortex device with a fuel and oxidant supply, multiple fuel stage lances are provided. The ultra low NOx gaseous fuel burner for process heating applications as disclosed in D1 enables non-luminous, uniform and combustion space filling flame with extremely low NOx emissions. This is accomplished by using a flame stabilizer for maintaining the overall flame stability and multiple uniformly spaced and diverging fuel lances downstream to inject balanced fuel in several turbulent jets inside the furnace space for creating massive internal flue gas recirculation. US 2007/254251 describes an ultra low NOx burner with a staggered angular placement of fuel nozzles and oxidant nozzles at circumferential locations with respect to the burner assembly axis. The fuel nozzles may be provided on a different radial distance from the burner assembly nozzle or at the same distance. Additionally, oxy-fuel flame stabilizers may be installed in the burner tile to provide flame stability during oxy-fuel firing.

The flame shape is determined by the burner tile, the drilling of the gas tip and the aerodynamics of the burner. Round burner tiles are used to produce a conical or cylindrical flame shape. Flat flame burners are designed with rectangular burner tiles and produce a fish tail shaped flame. These burners are used when firing close to refractory walls or where the tube clearance is limited.

Throughout this application, the terms "symmetry" and "asymmetry" of the flame front are based on the definition of three dimensional reflection symmetry. Three dimensional reflection symmetry is defined as symmetry of reflection around a plane of symmetry. For completeness sake, it is noted that two dimensional reflection symmetry may be defined as symmetry of reflection around a line or axis and thus clearly distinguishes from three dimensional reflection symmetry.

In further elaboration of the invention, the symmetry plane transverse to the end surface of the burner is defined as a symmetry plane of a burner tile, such as a round burner tile or a rectangular burner tile, of the burner, arranged at the end surface of the burner.

According to a further aspect of the invention, the exit opening of the oxidizing medium supply channel and the exit openings of the fuel supply channels are asymmetrically arranged with respect to any symmetry plane of the burner tile, wherein the symmetry plane or any symmetry plane is arranged transverse to the end surface, i.e. the burner tile arranged at the end surface of the burner.

Thus, according to the invention, the burner, at least the end surface of the burner including the exit opening of the oxidizing medium supply channel and the exit openings of the fuel supply channels, has no symmetry plane. Therefore, the flame front generated by the burner according to the invention has no symmetry plane as well. With such a burner the drawbacks of the prior art burners are at least partly overcome such that interaction of the flame fronts of adjacent burners is obviated and/or at least minimized, thereby reducing the risk on flame rollover.

The fuel exit openings are asymmetrically arranged. For example, the capacity of the fuel exit openings may differ, e.g. large capacity openings and small capacity openings, and the capacity is asymmetrically arranged. In an embodiment, the fuel exit openings itself may geometrically have a symmetrical distribution with respect to the symmetry plane, but there may be a difference between small capacity openings and large capacity openings resulting in an asymmetrical distribution of the capacity.

The invention is advantageously applied in furnaces for which it is critical to obtain the operation temperature of the firebox. This temperature can either be relatively high in a high temperature furnace or relatively low in a low temperature furnace.

Alternatively and/or additionally the geometrical distribution of the fuel exit openings may be asymmetrical with respect to the symmetry plane, resulting in an asymmetrical flame front. For example, when arranging identical fuel exit openings in an asymmetrical distribution, an asymmetrical flame front may be formed.

Alternatively and/or additionally the dimension of the exit openings may be asymmetrically arranged with respect to the symmetry plane, resulting in an asymmetrical flame front. For example, the fuel exit openings may be symmetrically arranged with respect to the symmetry plane, but by providing different dimensions of the exit openings that are asymmetrically distributed with respect to the symmetry plane, an asymmetrical flame front may be created.

Alternatively and/or additionally the exit angles of the exit openings may be asymmetrically distributed with respect to the symmetry plane to create an asymmetrical flame front.

Alternatively and/or additionally the shape of the exit openings may be asymmetrically distributed with respect to the symmetry plane to create an asymmetrical flame front.

By providing an end tip on the fuel supply channel, wherein the end tip comprises the exit opening, the asymmetrical arrangement of the fuel exit openings can be provided relatively easily. The end tips are usually exchangeable, so the arrangement of the exit openings may be varied by exchanging the end tips. Preferably, different end tips are provided to create an asymmetrical flame front. The end tips may differ in capacity, dimension of the exit openings, number of the exit openings, exit angle of the exit openings, shape of the exit openings, etc.

The invention further relates to a furnace comprising at least one burner providing an asymmetrical flame front.

Further advantageous embodiments are represented in the subclaims.

The invention will further be elucidated on the basis of exemplary embodiments which are represented in a drawing. The exemplary embodiments are given by way of non-limitative illustration of the invention.

Figure 6A:
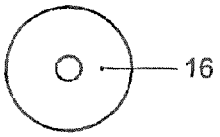
Figure 6B:
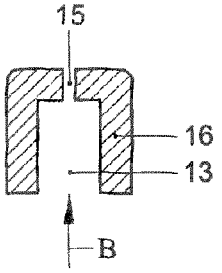

FIG. 6*a* shows a schematic front view of an end tip;

FIG. 6*b* shows a schematic cross section of the end tip of FIG. 6*a;*

Figure 7A:
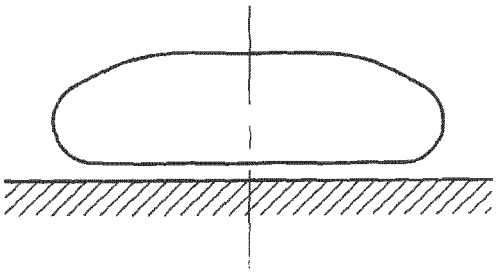
Figure 7B:
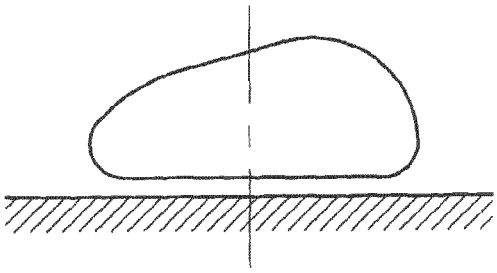
Figure 7C:
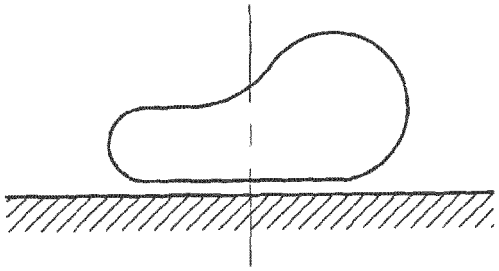
Figure 8A:
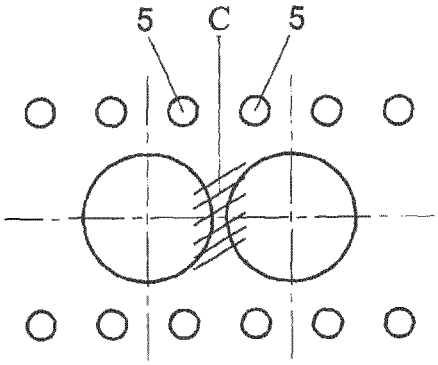
Figure 8B:
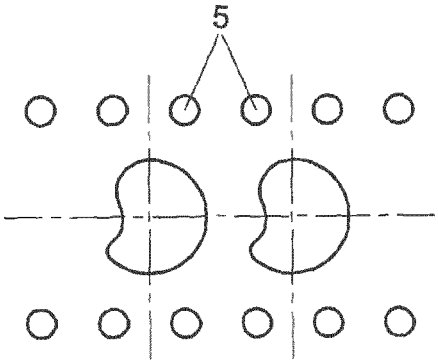

FIG. 7*a* shows a schematic cross section of a flame envelope of a standard prior art burner that is arranged on a side wall of a firebox;

FIG. 7*b* shows a schematic cross section of a flame envelope of a first embodiment of an asymmetrical burner according to the invention;

FIG. 7*c* shows a schematic cross section of a flame envelope of a second embodiment of an asymmetrical burner according to the invention;

FIG. 8*a* shows a schematic view of a cross section of a flame envelope of standard prior art burners that are arranged between tube lanes; and FIG. 8*b* shows a schematic view of a cross section of a flame envelope of burners according to the invention that are arranged between tube lanes.

It is noted that the figures are only schematic representations of embodiments of the invention that are given by way of non-limiting example. In the figures, the same or corresponding parts are designated with the same reference numerals.

Figure 1:
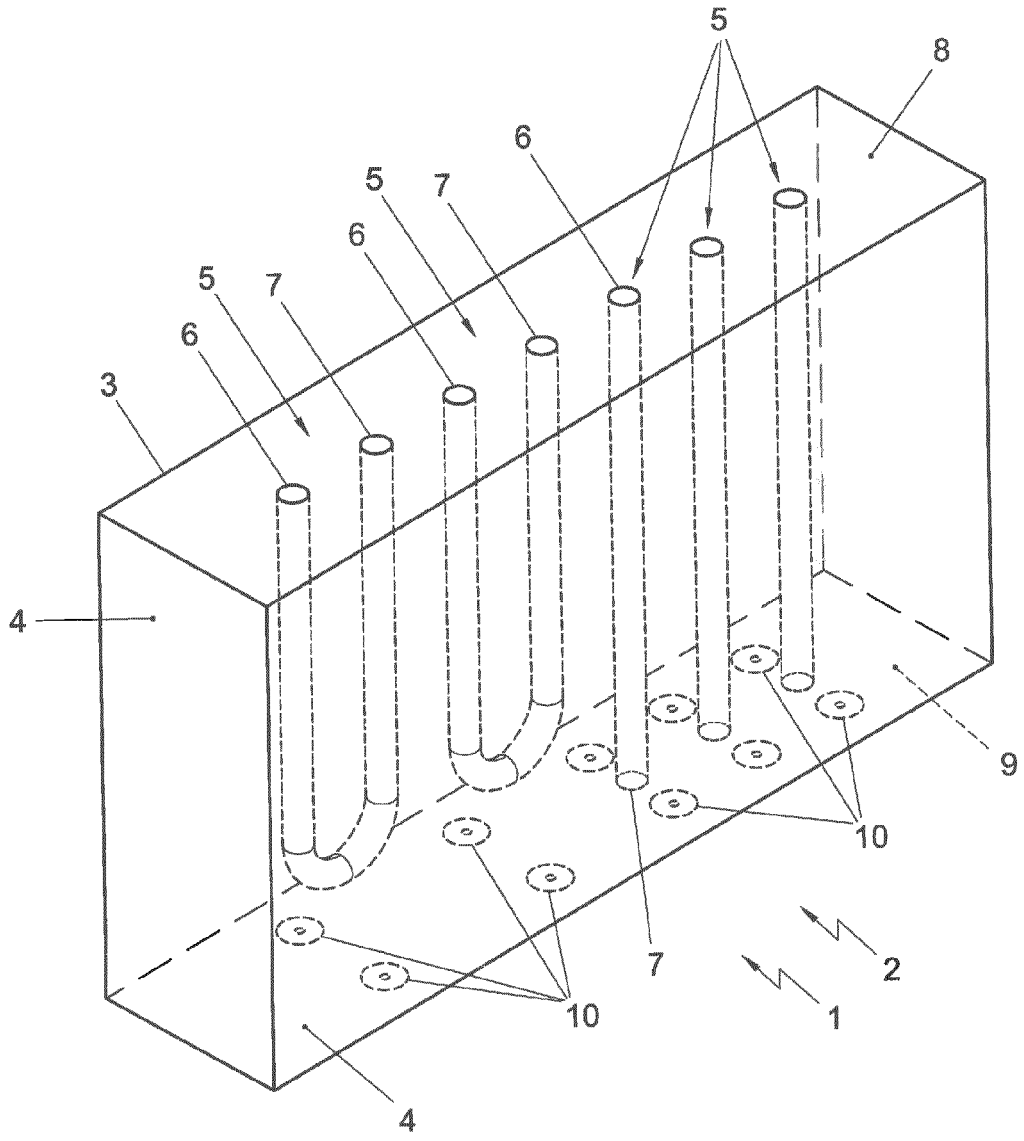
FIG. 1 shows a schematic perspective view of a furnace with burners according to the invention.

FIG. 1 shows a furnace 1 comprising a firebox or radiant section 2. The firebox 2 is here provided as a large rectangular closed chamber 3. Typically, the chamber 3 is about 3 to 4 meters wide, about 10 to 15 meters high and about 10 to 20 meters long. Approximately in the centre of the chamber, typically 1 to 2 meters from side walls 4 a row of tubular piping 5 is arranged. The tubular piping 5 can have an entrance opening 6 and a discharge opening 7 both arranged at a top side 8 of the chamber 3. The tubular piping 5 may then be arranged in a U-shape. Alternatively, the tubular piping 5 may have the entrance opening 6 at the top side 8 of the chamber 3 and may have the discharge opening 7 at a bottom side 9 of the chamber 3. Also, other arrangements are possible for the tubular piping.

In the walls 4, here the floor, a row of burners 10 is arranged. Alternatively, the burners may be arranged on the side walls or on the roof walls. The burners 10 are thus arranged on both sides of the tubular piping 5 and heat the tubular piping from both sides. In an other embodiment, the burners may be arranged between lanes of tubular piping. The burners 10 produce a flame front that heats the chamber 3 and the tubular piping 5 arranged in it. Typically the chamber 3 is heated up to approximately 1100° C. to 1400° C. for a high temperature furnace.

For example, in a high temperature furnace, a stream comprising hydrocarbons, such as ethane, propane or butane is transported through the tubular piping 5. Typically, this stream is transported with a velocity of approximately 200 m/s through the piping 5. The temperature of the stream at the entrance opening 6 is typically 500° C. to 600° C. During the relatively short residence time of the stream in the chamber 3, the temperature of the stream is heated up to approximately 800° C. to 900° C. to attain a chemical reaction to create e.g. ethylene or propylene.

Typically, the maximum temperature for the alloy of the tubular piping is about 1100° C. Therefore, it is important that the flame front does not reach the tubular piping 5, because then the temperature on the material would become too high and/or sediment is formed on the inner sides of the tubular piping that decreases the efficiency of the reaction. In view of a high efficiency the burners 10 are placed relatively close to each other, however, then flame rollover may occur, which may decrease the life time, efficiency and/or capacity of the piping 5 and/or the furnace 2.

FIG. 7*a* and FIG. 8*a* show schematically a cross section of a flame envelope of a standard symmetrical prior art burner. FIG. 7*a* shows the flame envelope of a side wall mounted symmetrical prior art burner. FIG. 8*a* shows the flame envelopes of symmetrical prior art burners that are placed between lanes of tubular piping 5. The tubular piping 5 may extend upwardly and the prior art burners may be arranged on the floor. Due to the symmetry of the flame envelopes, flame-to-flame interaction may occur at region C.

Figure 2:
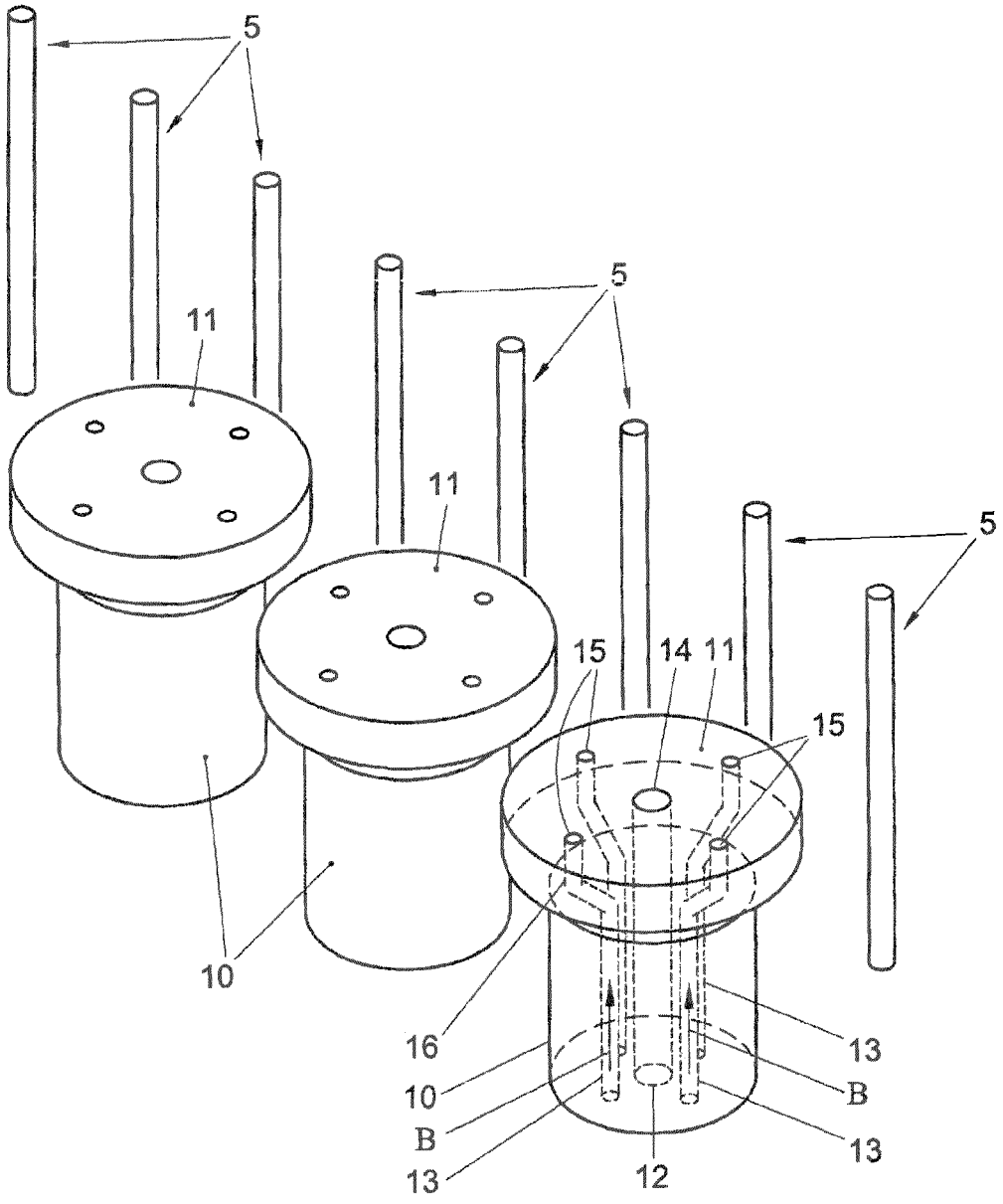
FIG. 2 shows a schematic perspective view of a detail of the furnace of FIG. 1.

FIG. 2 shows the burners 10 and the piping 5. Although the distance between the end surface 11 and the piping 5 is limited, typically approximately 0.5 to approximately 2 meters, the flame front may not extend onto the piping 5.

The burner 10 comprises a supply channel 12 for oxidizing medium, e.g. combustion air and a plurality of fuel supply channels 13. The fuel supply channels 13 are arranged peripheral with respect to the oxidizing medium supply channel 12. The supply channels 12, 13 have exit openings 14, 15 respectively that terminate at the burner end surface 11. The exit openings 14, 15 are arranged adjacent each other such that, during use, upon reaction of supplied fuel with supplied oxidizing medium a flame front is formed. The fuel exit openings 15 may terminate on the end surface 11, or may terminate slightly outside the end surface 11, e.g. when the fuel supply channel 13 extends somewhat from the end surface 11, or the fuel exit openings 15 may terminate inside the end surface 11, e.g. when the fuel supply channel 13 ends somewhat upstream of the end surface 11. Many variants are possible and are considered to fall within the scope of the exit openings 14, 15 arranged at the burner end surface 11.

During use, oxidizing medium is supplied via the oxidizing medium supply channel 12 and discharged via the oxidizing medium exit opening 14. The fuel is supplied via the fuel supply channels 13 and is injected via the fuel exit openings 15. The fuel and the oxidizing medium will react and a flame front is created that heats the chamber 3.

Preferably the flame front is asymmetrical, e.g. egg-shaped or concave shaped with inward curvature, etc. FIG. 7*b*, FIG. 7*c* and FIG. 8*b* show examples of asymmetrical flame envelopes from asymmetrical burners. With an asymmetrical flame front, the interaction with flame fronts of neighbouring burners 10 remains limited, which reduces the risk on flame rollover wherein the flame front reaches the piping 5. In particular FIG. 8*b* shows that the interaction between neighbouring asymmetrical flame envelopes may be absent.

Figure 3:
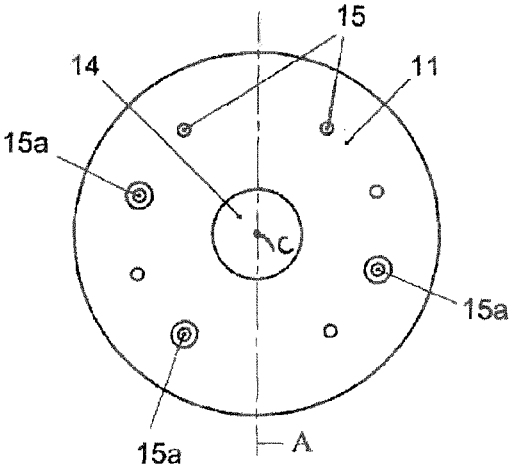
FIG. 3 shows a schematic front view of an embodiment of a burner end surface according to the invention.
Figure 4:
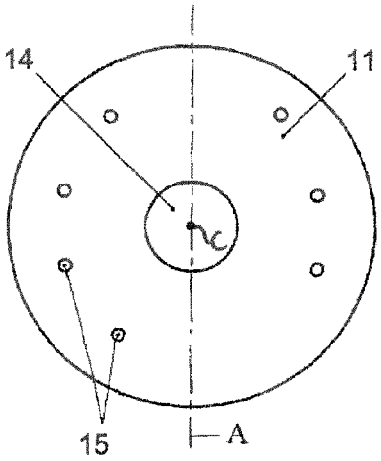
FIG. 4 shows a schematic front view of an embodiment of a burner end surface according to the invention.
Figure 5:
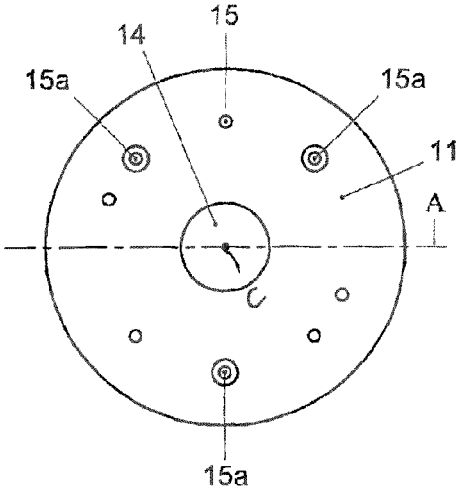
FIG. 5 shows a schematic front view of an embodiment of a burner end surface according to the invention.

To create an asymmetrical flame front, the fuel exit openings 15 are asymmetrically arranged with respect to a symmetry plane that is transverse to the end surface 11 of the burner 10. FIGS. 3, 4 and 5 give examples of an asymmetrical arrangement of fuel exit openings 15 with respect to a symmetry plane A. The symmetry plane A is defined as a symmetry plane of an end surface 11 at the burner 10, for instance of a burner tile arranged at the end surface 11 of the burner 10. Such a symmetry plane A extends transverse to the end surface 11 of the burner 10 and at the same time extends through a central axis (not shown) of the burner 10. In fact, the fuel exit openings 15 may be asymmetrically arranged with respect to any plane transverse to the end surface 11 of the burner 10 and extending through a central axis (not shown) of said burner 10. The fuel exit openings 15 can be asymmetrically arranged, as illustrated in FIG. 4. Also, the capacity of the fuel exit openings may be asymmetrically distributed, as illustrated in FIG. 3. Large capacity fuel exit openings 15*a* are asymmetrically distributed with respect to the symmetry plane A. The fuel openings 15, 15*a* are symmetrically arranged with respect to the symmetry plane A or to any other symmetry plane, only the capacity is asymmetrically arranged, resulting in an asymmetrical flame front.

In another embodiment, shown in FIG. 4, the fuel exit openings 15 are asymmetrically distributed with respect to the symmetry plane A, resulting in an asymmetrical flame front. In different wording, in FIG. 4, the fuel exit openings 15 are asymmetrically distributed with respect to a central axis C such that adjacent fuel exit openings 15 are arranged at mutual different circumferential distances and/or radial distances with respect to the central axis C.

In another embodiment, shown in FIG. 5, the fuel exit openings 15, 15*a* are asymmetrically distributed and the capacity of the fuel exit openings is asymmetrically arranged with respect to the symmetry plane A or any other symmetry plane. Large capacity fuel exit openings 15*a* are asymmetrically distributed with respect to the symmetry plane A. In addition, the fuel exit openings 15, 15*a* are asymmetrically distributed with respect to the symmetry plane A, resulting in an asymmetrical flame front. Also in this embodiment, radial distances between adjacent fuel exit openings 15, 15*a* and/or circumferential distances between adjacent fuel exit openings 15, 15*a* may vary.

Many compositions and distributions of the fuel exit openings are possible that result in an asymmetrical flame front, all are deemed to fall within the scope of the invention. Also, an asymmetrical flame front may be created by providing different exit angles and/or different dimensions and/or different shapes of the exit openings in an asymmetrical distribution with respect to the symmetry plane.

The end part of the fuel supply channel 13 comprises a number of end tips 16 which are according to the invention asymmetrically arranged. The end tip 16, as shown in FIG. 6, comprises the fuel exit opening 15. Fuel gas flows through the channel 13 in the direction of arrow B. The end tip 16 may be exchangeable, preferably during use of the furnace 2. Due to the exchangeability of the end tip 16, for example a normal capacity end tip 15 may be relatively easily replaced by a large capacity end tip. Also, the end tip 16 may comprise different exit openings 15. The exit openings 15 may have different exit angles and/or different dimensions and/or different shapes. By providing an asymmetrical distribution of end tips with different characteristics of the exit openings, such as dimension, shape, exit angle, capacity, etc. an asymmetrical flame front may be created.

Many variants will be apparent to the person skilled in the art. All variants are understood to be comprised within the scope of the invention as defined in the following claims.

The invention claimed is:

1. A burner for a furnace comprising at least one supply channel for supplying an oxidizing medium and a plurality of peripheral fuel supply channels, wherein the oxidizing medium supply channel and the fuel supply channels have exit openings arranged adjacent each other at a burner end surface for forming during use upon reaction of supplied fuel with supplied oxidizing medium a flame front, wherein the exit opening of the oxidizing medium supply channel and the exit openings of the fuel supply channels are asymmetrically arranged with respect to at least one symmetry plane transverse to the end surface of the burner and extending through a burner central axis whereby the distribution of the fuel exit openings and/or the dimension of the fuel exit openings and/or the exit angle of the fuel exit openings and/or the shape of the fuel exit openings are arranged asymmetrically to said symmetry plane, such that during use the flame front created is asymmetrical with respect to the at least one symmetry plane transverse to the end surface.

2. Burner according to claim 1, wherein the fuel supply channel comprises an end tip comprising at least one fuel exit opening.

3. Burner according to claim 2, wherein the arrangement of at least one end tip differs from other end tips of the burner.

4. Burner according to claim 2, wherein the end tip is exchangeable.

5. Burner according to claim 1, wherein the burner is a Large Scale Vortex® burner.

6. Furnace comprising at least one burner according to claim 1.

7. Furnace according to claim 6, wherein the burners are arranged in a row on a wall of a firebox of the furnace.

* * * * *